US005317311A

United States Patent [19]

Martell et al.

[11] Patent Number: 5,317,311

[45] Date of Patent: May 31, 1994

[54] TRAFFIC CONGESTION MONITORING SYSTEM

[76] Inventors: David K. Martell, Green End, Bedfordshire; Ian R. Williams, 25 Pemberley Avenue, Bedford, both of United Kingdom

[21] Appl. No.: 555,458

[22] PCT Filed: Nov. 14, 1989

[86] PCT No.: PCT/GB89/01348

§ 371 Date: Sep. 13, 1990

§ 102(e) Date: Sep. 13, 1990

[87] PCT Pub. No.: WO90/05969

PCT Pub. Date: May 31, 1990

[30] Foreign Application Priority Data

Nov. 14, 1988 [GB] United Kingdom ..... 8826624

[51] Int. Cl.[5] ..... G08G 1/09

[52] U.S. Cl. ..... 340/905; 340/901; 364/436; 455/345

[58] Field of Search ..... 340/933, 934, 936, 937, 340/942, 943, 901, 905, 286.14; 364/436–438; 455/205, 345

[56] References Cited

U.S. PATENT DOCUMENTS

| | | | |
|---|---|---|---|
| 3,056,106 | 9/1962 | Hendricks | 340/933 |
| 3,199,074 | 8/1965 | Hales et al. | 340/934 |
| 3,322,940 | 5/1967 | Barker et al. | 340/934 |
| 3,516,056 | 6/1970 | Matthews | 340/942 |
| 4,398,171 | 8/1983 | Dahan et al. | 340/901 |
| 4,760,531 | 7/1988 | Yasui et al. | 340/995 |
| 4,792,803 | 12/1988 | Madnick et al. | 340/905 |
| 4,812,843 | 3/1989 | Champion, III et al. | 340/905 |
| 5,020,143 | 5/1991 | Duckeck et al. | 340/905 |

FOREIGN PATENT DOCUMENTS

| | | | |
|---|---|---|---|
| 0085013 | 8/1983 | European Pat. Off. | 340/905 |
| 0263332 | 4/1988 | European Pat. Off. . | |
| 0287827 | 10/1988 | European Pat. Off. . | |
| 0290679 | 11/1988 | European Pat. Off. . | |
| 0300205 | 1/1989 | European Pat. Off. . | |
| 0318260 | 5/1989 | European Pat. Off. | 340/936 |
| 0029201 | 5/2781 | European Pat. Off. . | |
| 2157821 | 5/1973 | Fed. Rep. of Germany . | |
| 3013950 | 10/1981 | Fed. Rep. of Germany . | |
| 3128578 | 2/1983 | Fed. Rep. of Germany | 340/934 |
| 3142978 | 5/1983 | Fed. Rep. of Germany . | |
| 2554618 | 5/1985 | France . | |
| 0121383 | 9/1979 | Japan | 340/905 |
| 0189000 | 7/1989 | Japan | 340/905 |
| 2050767 | 1/1981 | United Kingdom . | |
| WO8902142 | 3/1989 | World Int. Prop. O. . | |

*Primary Examiner*—Brent Swarthout
*Attorney, Agent, or Firm*—William D. Hall

[57] ABSTRACT

A traffic congestion monitoring system comprises infrared monitoring units bolted to the sides of bridges over a motorway network and emitting information as to traffic congestion at their locations, a control center which receives and transmits the information, and paging units in respective vehicles and receiving the information and visually displaying the same upon diagrams of the network or zones thereof.

18 Claims, 5 Drawing Sheets

TRAFFIC CONGESTION MONITORING SYSTEM

BACKGROUND OF THE INVENTION

1. Field of the Invention

This invention relates to a traffic congestion monitoring system.

2. Description of the Related Art

It is conventional to advise police or highway officials of traffic congestion upon main roads by monitoring such congestion visually or by closed-circuit television for example. It is also conventional to advise drivers of congestion locations by broadcasting details of such congestion locations on ordinary or special radio channels to which conventional vehicle radios can be tuned. A drawback of such conventional systems for the drivers is the time delay between the build-up of congestion at a location and the communication of that information to the driver, often with the result that he is unable to avoid that location. The time delay may be worsened by the facts that the broadcasting announcer naturally has to give information about the congestion locations in turn, which also means that the driver has to carry the information in his mind in order to be able to work out a route avoiding all of the congested locations. Moreover, only serious congestion locations may be identified in the announcement, to reduce the interruption of ordinary broadcasting. The transient and aural nature of the presentation of the information to the driver mean that if the driver is not listening to the broadcast or cannot hear the broadcast (for example because the vehicle is in a tunnel or because a passenger is talking to him) when the information is given, he has to await the next bulletin.

Another drawback is that the monitoring involves employing personnel continuously to watch the locations.

SUMMARY OF THE INVENTION

According to a first aspect of the present invention there is provided a traffic congestion monitoring system, comprising detecting means disposed at a location and serving to detect stationary or slow-moving traffic units at said location, transmitting means communicating with said detecting means to receive from said detecting means signals representing information as to congestion at said location and arranged to transmit signals representing said information, and receiving means carried by traffic units and arranged to receive the transmitted signals and to present said information at the traffic units carrying said receiving means.

According to a second aspect of the present invention there is provided a traffic congestion monitoring system, comprising a plurality of detecting means disposed at respective locations remote from each other and serving to detect stationary or slow-moving traffic units at their respective locations, and to emit signals representing information as to congestion at said locations, transmitting means arranged to transmit signals representing said information, and receiving means carried by traffic units and arranged to receive the transmitted signals and to present said information at the traffic units carrying said receiving means, the receiving means at each unit being arranged to present the information as to congestion at said respective locations simultaneously.

According to a third aspect of the present invention there is provided a traffic congestion monitoring system, comprising detecting means disposed at a location and serving to detect stationary or slow-moving traffic units at said location and to emit signals representing information as to congestion at said location, transmitting means arranged to transmit signals representing said information, and receiving means carried by traffic units and arranged to receive the transmitted signals and to present said information at the traffic units carrying said receiving means, said receiving means serving to present said information as aforesaid continuously for as long as said information is relevant.

According to a fourth aspect of the present invention there is provided a traffic congestion monitoring system, comprising detecting means disposed at a location and serving to detect stationary or slow-moving traffic units at said location and to emit signals representing information as to congestion at said location, transmitting means arranged to transmit signals representing said information immediately after the emission of that information by said detecting means, and receiving means carried by traffic units and arranged to receive immediately the transmitted signals and immediately to present said information at the traffic units carrying said receiving means.

According to a fifth aspect of the present invention, there is provided a traffic congestion monitoring system, comprising detecting means disposed at a location and serving to detect stationary or slow-moving traffic units at said location, and to emit signals representing information as to congestion as to said location, transmitting means arranged to transmit signals representing said information, and receiving means carried by traffic units and arranged to receive the transmitted signals and to present said information visually at the traffic units carrying said receiving means.

According to a sixth aspect of the present invention, there is provided a traffic congestion monitoring system, comprising detecting means disposed at a location and arranged to detect infra-red radiation emitted by stationary or slow-moving traffic units at said location, timing means arranged to determine when the frequency of pulses of infra-red radiation from said traffic units at said location falls below a threshold value for a predetermined time period, and signal-emitting means arranged to emit a signal upon said frequency falling below said threshold value for said time period.

Owing to the above aspects of the invention, it is possible immediately, visually and during all the time period of relevance, to advise drivers of congestion at a plurality of locations simultaneously. Moreover, personnel are not needed to watch the location continuously.

The units of traffic may be pedestrians, cyclists, or motor vehicles, for example.

According to a seventh aspect of the present invention, there is provided a vehicle carrying receiving means arranged to receive information as to traffic congestion at a location and to receive messages, unrelated to the traffic congestion, for a person at said vehicle, and visual display means connected to said receiving means and serving to display said information and said messages.

Owing to this aspect of the invention, a driver can receive visually not only traffic congestion information but also personal messages, for example.

According to an eighth aspect of the present invention, there is provided a vehicle carrying receiving means arranged to receive information as to traffic congestion at a location in one zone of a plurality of zones of a vehicular route network, and visual display means connected to said receiving means and serving to display, selectively, a diagram of said network or a diagram of said one zone with said information.

Owing to this aspect of the invention, a driver can see either the whole network, or a zone thereof more distinctly.

BRIEF DESCRIPTION OF THE DRAWINGS

In order that the invention may be clearly understood and readily carried into effect, reference will now be made, by way of example, to the accompanying drawings, in which FIG. 4*a* illustrates the backlight driver and the battery charging control.

Figure 1:
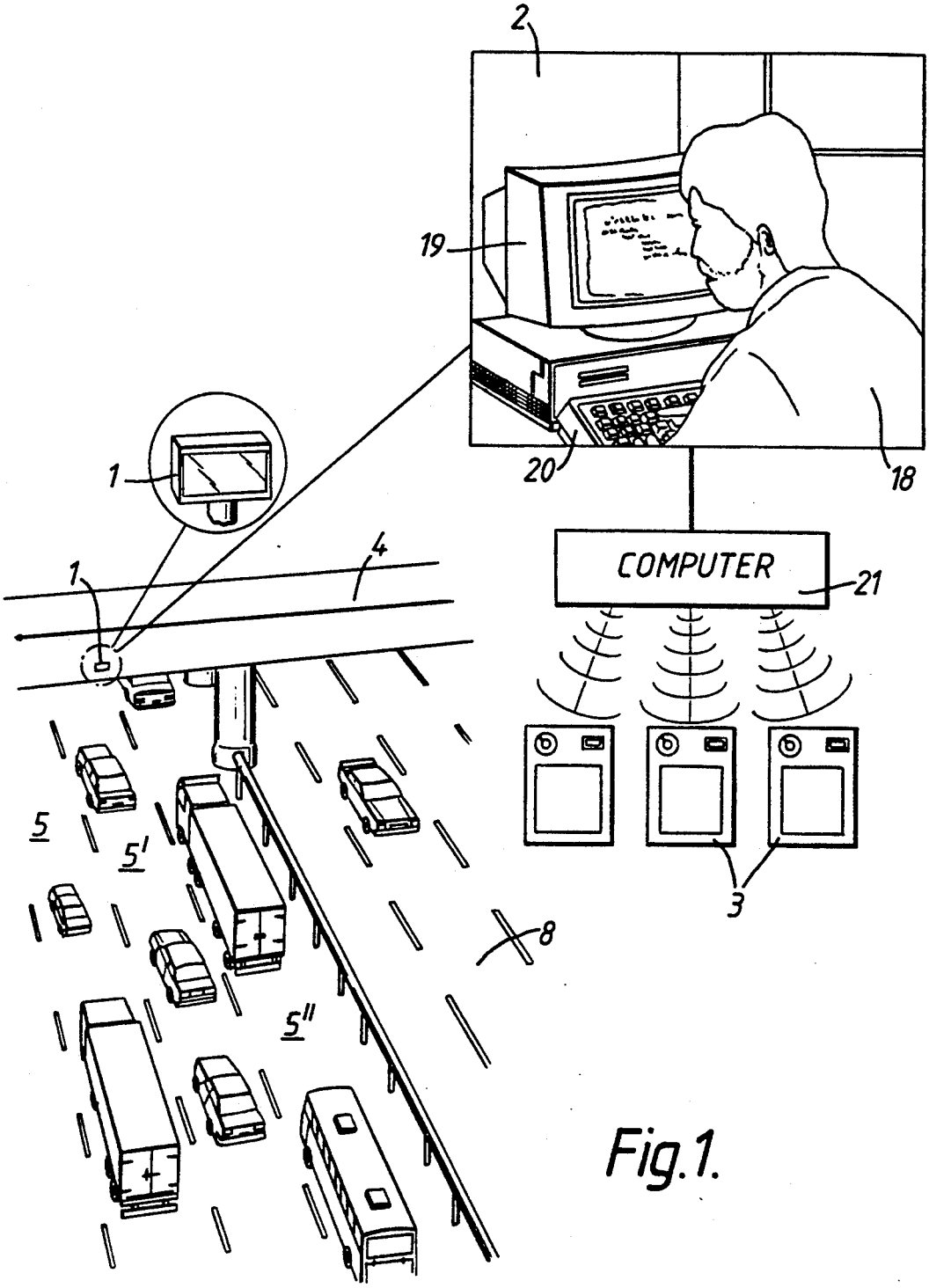
FIG. 1 shows diagrammatically a traffic congestion monitoring system.
Figure 2:
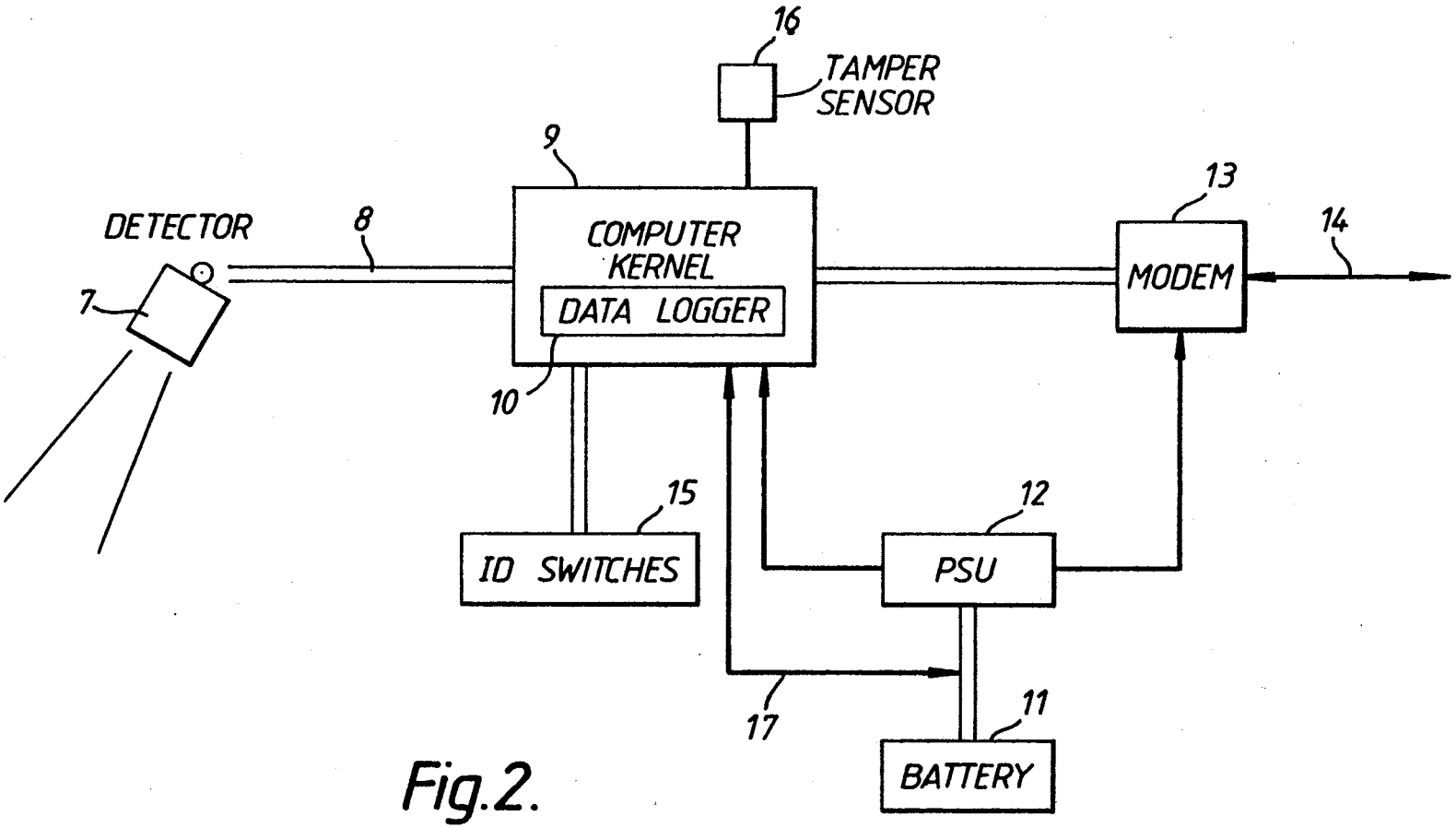
FIG. 2 shows diagrammatically electrical circuitry of one of a plurality of identical monitoring units of a traffic congestion monitoring system.
Figure 3A:
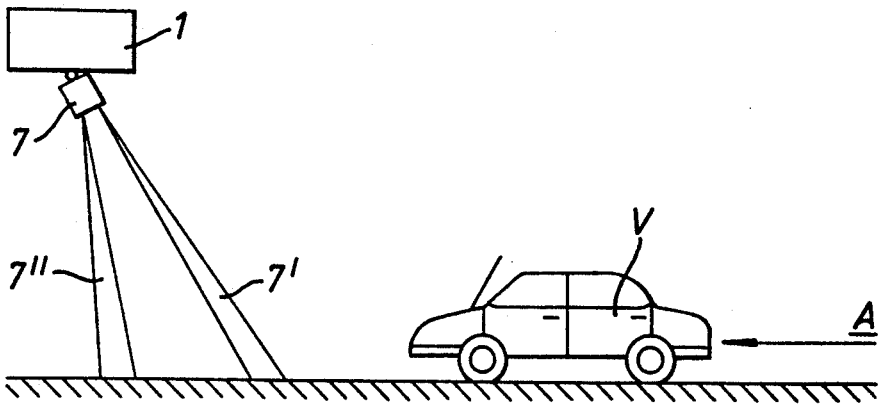
FIGS. 3*a* and 3*b* are a diagrammatic side elevation and a diagrammatic plan view, respectively, illustrating detection of vehicle speed by one of the monitoring units.
Figure 3B:
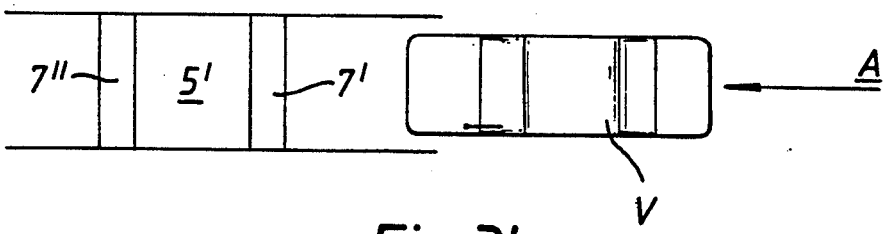
Figure 6:
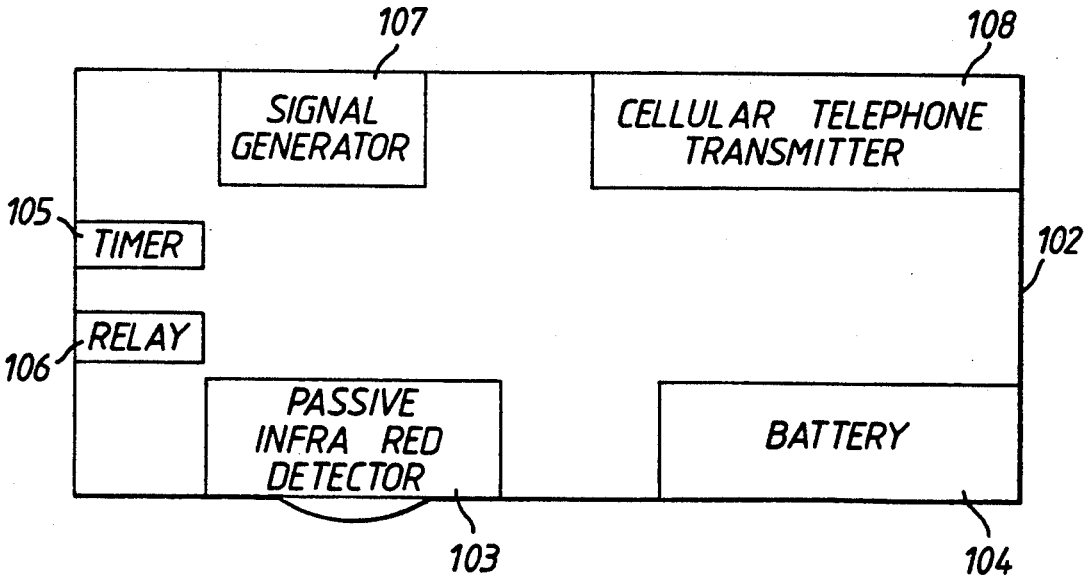
FIG. 6 shows a modified version of the monitoring unit.
Figure 4:
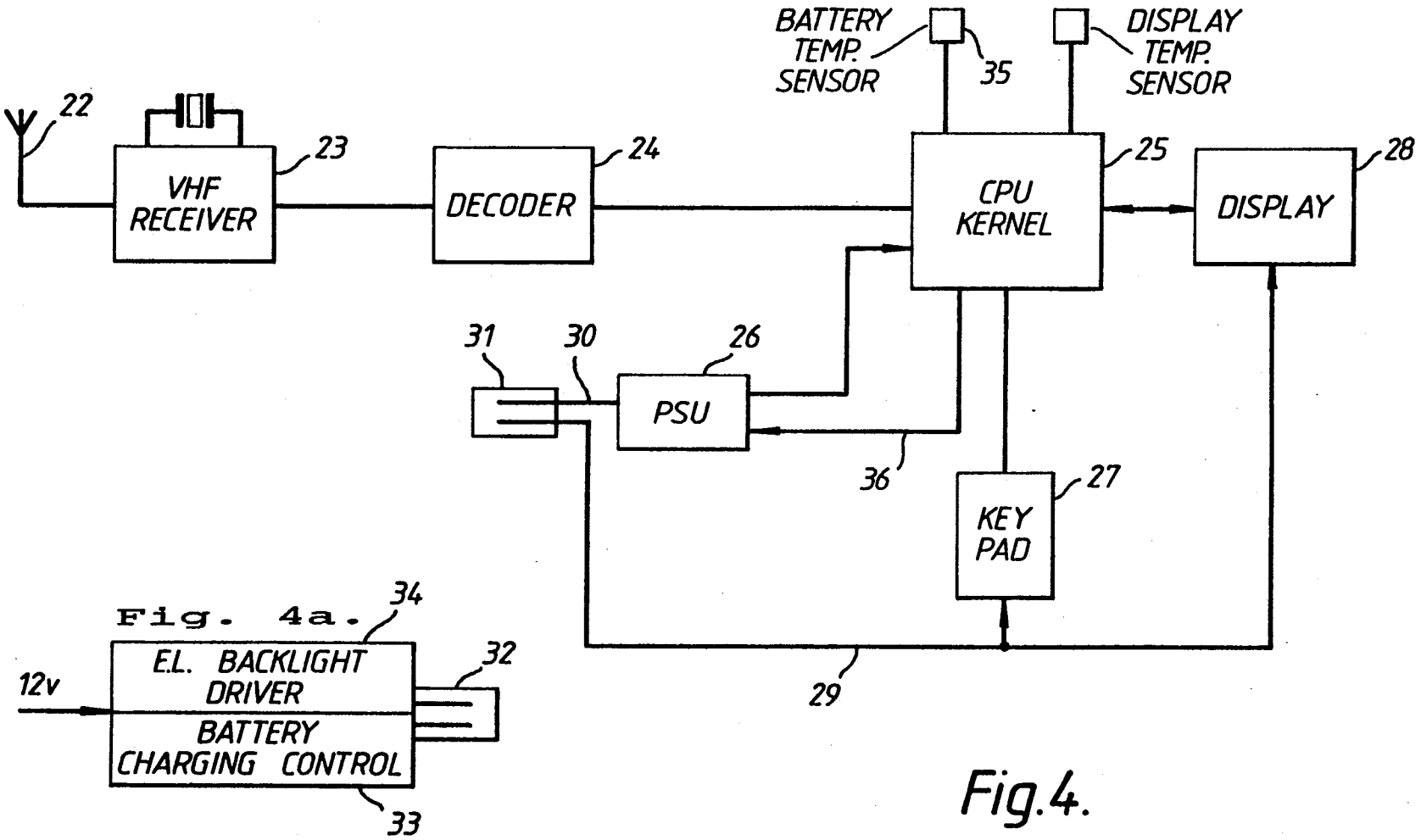
FIG. 4 shows diagrammatically electrical circuitry of one of a plurality of identical paging units of the system.

The system of FIG. 1 comprises three types of components, namely monitoring units 1 each as shown in FIGS. 1 and 2, a control centre 2 and paging units 3 each as shown in FIGS. 4 and 5.

Figure 5A:
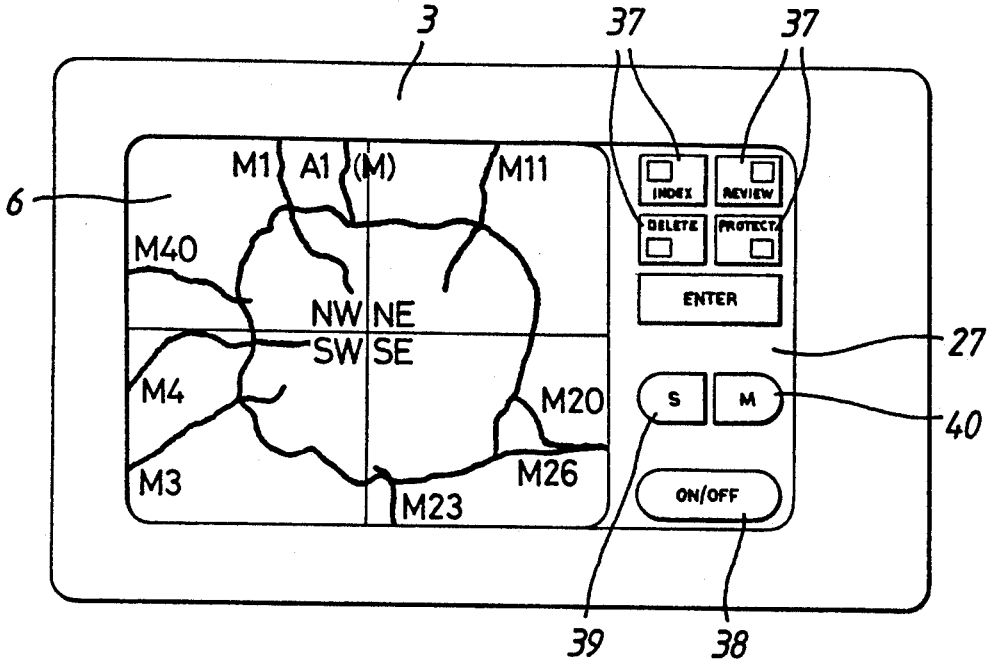
FIGS. 5*a* and 5*b* are a front elevation of one of the paging units, with a screen thereof displaying the whole of the London motorway network and a North-Eastern quadrant thereof, respectively.

Respective monitoring units 1 each as shown in FIG. 1 are bolted to the sides of bridges 4 over one carriageway 5 of each of the motorways (M1 etc) shown on the screen 6 in FIG. 5*a*. Although shown positioned over an intermediate-speed lane 5 in FIG. 1, the unit 1 is preferably positioned over the highest-speed lane 5″. Each monitoring unit 1 is compact (e.g. 400 mm×280 mm×150 mm). Access to the unit 1 for maintenance is from the bridge 4. Each unit 1 includes an active infra-red detector 7 and is connected to another detector in a remote housing (not shown) which is positioned above the other carriageway 80 to enable the unit 1 to report hold-ups in either direction.

The detectors 7 are mounted about 35 ft above the traffic. Each detector 7 produces two obliquely downwardly directed beams 7′ and 7″ of infra-red radiation each extending across the width of the lane 5′. As a vehicle V travelling in the direction A of traffic flow intercepts the first beam 7′, the detector 7 emits a first electrical signal which is passed via a line 8 to a computer kernel 9 and, as the vehicle intercepts the second beam 7″, the detector emits a second signal which is again passed via the line 8 to the kernel 9. The kernel 9 includes a data logger 10 comprising a 256K byte RAM backed by a battery 11 through a power supply unit 12. The kernel also includes a timer which measures the time interval between the two signals, such time interval naturally representing the speed of the vehicle V, and, if the time interval is greater than a threshold value corresponding to, say, 25 mph, in other words the speed is less than 25 mph, as an average for the vehicles passing during a given time period of, say, three minutes, the kernel 9 sends a message to a modem 13 the output of which is connected by a telephone line 14 to the control centre 2. The timer is adjustable to set the threshold value. Connected to the kernel 9 is a bank 15 of identify (ID) switches and each monitoring unit 1 has its own individual identity given by selection of an individual ID switch. The first part of each message emitted by the kernel 9 is the address of the individual unit 1 as determined by the selected switch. Also connected to the kernel 9 is a tamper sensor 16 which causes the kernel 9 to send an alarm message to the control centre 2 if the unit 1 is tampered with. By way of a line 17, the kernel 9 monitors the output voltage of the battery 11 and, if the voltage falls below a desired level, the kernel sends a warning message to the centre 2.

In an alternative version (not illustrated), each monitoring unit 102 employs, instead of active infra-red detectors, a passive infra-red detector 103 which thus detects motor vehicles stationary or moving at or below, say, 15 mph from the infra-red radiation emitted by the vehicles. The detector 103 detects a radiation with a wavelength of approximately 9 Microns in three zones. Each detector 103 when operated closes contacts to provide current from a 12 v battery 104 to energize a timer 105. The timer 105 not only detects the time interval between infra-red radiation pulses provided by respective passing motor vehicles, and thus the pulse frequency, but also emits a signal when the pulse frequency falls below a threshold value for a set time period. The timer is adjustable to set the threshold value and the time period, and thus the sensitivity of the unit 102 to the degree of congestion. The timer 105 can handle simultaneous signals from the detector 103 and the remote detector (not shown). When the timer detects that the threshold value has been undershot for the set time period, it acts to energize a relay 106 to close the relay contacts to energize a cellular telephone transmitter 108, for example. The respective outputs from the timer are connected to a signal generator 107 and a remote signal generator (not shown). Coded messages are sent by the signal generators via the transmitter 108 to the control centre 2.

For the remote detector, a different identifying signal is employed. Should there be congestion in both directions, two differing signals are emitted or transmitted.

The control centre 2 in this example covers the London area motorways. Up to 100 units 1 may be deployed in this area. Messages will be transmitted by the telephone lines 14 from the monitoring units to the control centre. At the control center 2 is a control operator 18 watching a VDU (Visual Display Unit) 19. As an address/speed message arrives at the centre, the address, the speed and the time of day are displayed upon the VDU screen and are logged into a computer data base at the centre 2.

The address enables the operator 18 to identify the monitoring unit that is reporting to him. Upon receipt of the message and by way of a keyboard 20, the operator keys into a direct input paging service computer 21 stating the location of the traffic hold-up. The paging service computer immediately emits messages which are transmitted via VHF to the units 3.

In an alternative version, the messages received at the control centre may be used automatically to operate the paging service, an operator possibly maintaining merely a supervisory role.

The messages transmitted by the paging service each comprise firstly a code to activate all of the units 3, secondly a code representing the hold-up location and thirdly a code representing vehicle speed.

Subscribing drivers would receive accurate, immediate congestion information through paging units 3 linked in a pager network. Motoring organizations and police could also have access to the information from the control centre 2.

Referring to FIGS. 4 and 5, each paging unit 3 is mounted immediately in front of a driver of a vehicle, for example either at the dashboard or at eye level, and in the embodiment shown is a portable unit. Each unit 3 includes an antenna 22 of a VHF receiver 23, the output from which is fed to a POCSAG decoder 24. The output signals from the decoder 24 are fed to a computer kernel 25 supplied with power by a power supply unit 26 containing a rechargeable battery. Connected to the kernel 25 are an operating key pad 27 and a liquid crystal display device 28 including the screen 6. The pad 27 and the device 28 both have electroluminescent back lighting arrangements for night-time use and powered through a common line 29. The line 29 and a power supply input line 30 have input terminals in a plug 31 insertable into a fixed socket 32 and thereby connectible with a main battery of the vehicle via a backlight driver 34 and a battery charging control device 33. Connected to the kernel 25 is a battery temperature sensor 35 which monitors the state of charge of the battery in the unit 26 and causes the kernel 25 to produce a warning on the screen 6 in the event of it falling below a desired minimum. Also connected to the kernel 25 is a temperature sensor for the device 28, whereby the kernel 25 automatically varies the display contrast with temperature variation. By way of a line 36, the kernel 25 monitors the output voltage of the battery in the unit 26 and, if the voltage falls below a desired level, the kernel causes a warning to appear upon the screen 6.

Figure 5B:
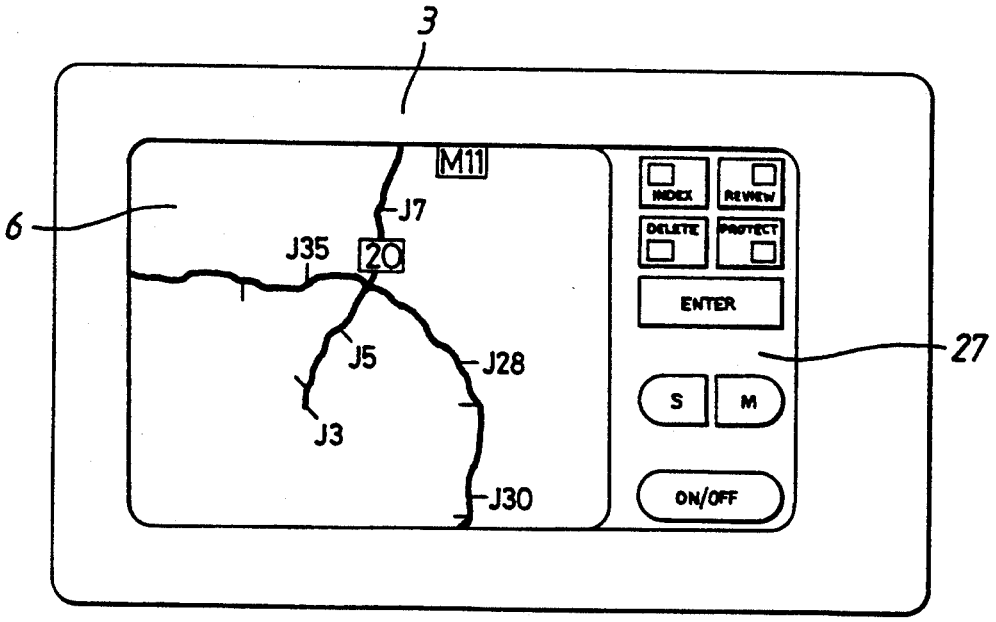

The paging unit 3 carried by each motor vehicle emits an audible tone when the information is received. It then displays simultaneously on the illuminated screen 6 the locations of particular hold-ups to enable the driver to take avoiding action. The display consists of the outline map of the motorway network. Any area of congestion is illuminated to warn the driver immediately. A different color illuminates depending on which carriageway is affected. The map in FIG. 5*a* is divided into four quadrants, marked NW (North-West), NE (North-East), SW (South-West) and SE (South-East), which are stored in the kernel 25 and any one of which can be brought to occupy the whole screen 6, as in FIG. 5*b*, automatically or manually. In automatic display of a single quadrant, once a location of congestion has been illuminated on the whole map in FIG. 5*a*, after a short time, say four seconds, the quadrant containing the congestion location replaces the whole map in the display. In manual display of a single quadrant, any one of four keys 37 arranged in a pattern and an orientation corresponding to those of the quadrants can be depressed to bring the corresponding quadrant to occupy the screen. At the illuminated congestion location on the screen 6, there is displayed the vehicle speed at that location, as shown in FIG. 5*b* where the framed numeral 20 represents 20 mph. Various officially numbered junctions (J7, etc.) are also shown to enable the driver to judge more reliably at which particular junctions to leave or join the motorway to avoid the congestion location.

Included in the keypad 27 is an on/off key 38, upon the operation of which to switch on the paging unit 3, the whole map appears upon the screen 6, a standby key 39 whereby the unit can be caused to store congestion information from received messages but not to display the same, whereby battery power which would otherwise be used to energize the display device 28 is saved, and a message key 40 whereby, if the paging service additionally transmits personal messages to the driver in a conventional manner, these messages can be displayed upon the screen 6 in place of the traffic congestion information. In this personal message mode, the four keys 37 are operable to cause the screen 6 to display an index of stored personal messages (INDEX), to enable the driver to review selected ones (REVIEW), to enable the driver to delete selected ones (DELETE) and to enable the driver to protect oldest personal messages against automatic deletion (PROTECT), such key functions being conventional in conventional personal message paging units.

The communication arrangements are as follows:

1. Any monitoring unit 1 or the control centre 2 may initiate communication.
2. A reply is expected to any communication.
3. Every monitoring unit is assigned a unique addres.
4. Every monitoring unit 1 may be fitted with two detectors 7, one for the Northbound (or Eastbound) lane, the other for the Southbound (or Westbound) Lane.
5. Communication of a message in either direction takes the form:
   STX (Start Code), ADDRESS, COMMAND, DATA (2 bytes), ETX (End Code), LRC (Check Sum)
6. The LRC is the Exclusive OR of all data bytes inclusive of STX and ETX.
7. The communications operate at 600 or 1200 baud.
8. Data Communications.
   a) Status Test—the control centre 2 to a monitoring unit 9:
      The control centre 2 interrogates the monitoring unit; the monitoring unit replies.
      The monitoring unit checks the transfer for errors and accepts or rejects the transfer by sending a message reply or by sending NAK (Not Acknowledged). If the monitoring unit sends NAK the interrogation is repeated. The process is repeated up to three times before disconnecting the line.
      The control centre checks the transfer for errors and accepts or rejects the transfer using ACK (Acknowledged) or NAK. If the control centre sends NAK the transfer is repeated.
      The process is repeated up to three times before declaring a link error at that address.
      If the monitoring unit NAK'ed three times, it disconnects the line.
      If the monitoring unit fails to reply within a specific time, a time-out error is declared at that address.
      If a connection is established but a transfer is not completed, the monitoring unit disconnects the line after a time-out.
   b) Transfer from a monitoring unit 9 to the control centre 2:
      The monitoring unit initiates the transfer and the control centre replies.
      If a monitoring unit attempts to make a connection to the control centre but finds the control centre's line busy, then it releases the line and repeats the attempt after a random time not exceeding two minutes.

The control centre checks the transfer for errors and accepts or rejects the transfer using ACK or NAK. If the control centre sends NAK the transfer is repeated.

The process is repeated up to three times before declaring a link error at that address.

If a monitoring unit is NAK'ed three times, it disconnects the line and repeats the attempt after a random time not exceeding two minutes.

If the monitoring unit fails to reply within a specific time, a time-out error is declared at that address.

If a connection is established but a transfer is not completed, the monitoring unit disconnects the line after a time-out.

9. Monitoring Unit

The monitoring unit monitors the infra-red detector for correct operation. If one sensor consistently fails to operate an error code is included in the reply to the Status Test.

The speeds for Northbound and Southbound lanes are included in the reply to the Status Test and speeds of 0 to 70 mph are identifiable in 5 mph increments.

Vehicle speeds are computed in one minute increments. The average speed is computed over the three minutes, to give a rolling average of the last three minutes.

10. Control Centre

Each time a monitoring unit 9 reports that speeds are below the threshold, a message is displayed on the VDU screen and on a printer.

The control centre undertakes a Status Test to each monitoring unit periodically at a desired frequency.

Each time a Status Test is sent to a monitoring unit and error conditions are detected, a message is displayed and printed.

Failure of the communications link results in a message being displayed and printed.

The control centre holds on disc a site history for each monitoring unit, the site history containing two separate files:

vehicle speeds vs calendar time errors and fault logging.

The system hereinbefore described has the advantages that reliable reports of traffic delays are immediately given to drivers, so that they have sufficient warning to take avoiding action, and that the system can be installed and maintained without excavating the carriageways and causing further congestion.

We claim:

1. A vehicle carrying receiving means arranged to receive information as to traffic congestion at a location as represented by traffic units average speed at said location and to receive messages, unrelated to traffic congestion, for a person at said vehicle, and visual display means connected to said receiving means and serving to display that information indicative of traffic units average speed at said location and said messages, said visual display means serving to display a vehicular route diagram and said information indicative of said average speed being displayed in the region of a position on said diagram corresponding to said location.

2. A vehicle according to claim 1, wherein said information indicative of average speed is displayed in digital form.

3. A traffic congestion monitoring system, comprising detecting means disposed at a location and serving to detect stationary or slow-moving traffic units at said location, transmitting means communicating with said detecting means to receive from said detecting means signals representing information as to congestion at said location as represented by traffic units average speed at said location and arranged to transmit signals representing said information, and receiving means carried by traffic units and arranged to receive the transmitted signals and to receive messages, unrelated to traffic congestion, for persons at said traffic units, said receiving means including visual display means arranged to present visually, at the traffic units carrying said receiving means, information indicative of said average speed and said messages, said visual display means serving to display a vehicular route diagram, and said information indicative of said average speed being displayed in the region of a position on said diagram corresponding to said location.

4. A system according to claim 3, wherein said information indicative of said average speed is displayed in digital form.

5. A system according to claim 3, and further comprising a second detecting means disposed at a second location remote from the first-mentioned location and serving to detect stationary or slow-moving traffic units at said second location and to emit signals representing information as to congestion at said second location, said transmitting means serving to transmit signals representing said information relating to the first and second locations, the receiving means at each unit being arranged to present the information as to congestion at said first and second locations simultaneously.

6. A system according to claim 3 wherein said receiving means serves to present said information, as aforesaid, continuously for as long as said information is relevant.

7. A system according to claim 3, wherein said transmitting means is arranged to transmit said signals representing said information immediately after the emission of that information by said detecting means, and said receiving means is arranged to receive immediately the transmitted signals and immediately to display said information at the visual display means of the traffic units.

8. A system according to claim 3, wherein each receiving means is in the form of a portable unit.

9. A system according to claim 3, wherein each visual display means includes selecting means whereby the display means can be caused to display, selectively, a diagram of a vehicular route network, or a diagram of any one zone of a plurality of zones of said network.

10. A system according to claim 3, wherein each detecting means comprises infra-red beam emitting means arranged to emit first and second beams of infra-red radiation to be intercepted in turn by a traffic unit to be detected, the time interval between the two interceptions being thereby proportional to the average speed of the traffic unit, and first and second sensing means arranged to sense the respective interceptions and to emit respective signals.

11. A system according to claim 10, wherein there are at least two of the said detecting means.

12. A system according to claim 3, wherein each detecting means has electrically associated therewith an identifying means whereby any message initiated by said detecting means includes a part identifying said detecting means.

13. A system according to claim 12, wherein there are at least two of said detecting means.

14. A system according to claim 3, wherein each detecting means is arranged to detect infra-red radiation emitted by stationary or slow-moving traffic at its location, and the system further includes, connected to each detecting means, timing means arranged to determine when the frequency of pulses of infra-red radiation from said traffic units falls below a threshold value for a predetermined time period, and signal-emitting means arranged to emit a signal upon said frequency falling below said threshold value for said time period.

15. A system according to claim 14, wherein there are at least two of said detecting means.

16. A system according to claim 9, wherein said diagram of said zone is to a larger scale than is said diagram of said network.

17. A system according to claim 9, wherein each display means includes selecting means whereby a person can manually select any one zone of said zones for display.

18. A system according to claim 9, wherein each display means has automatic selecting means whereby any one zone of said zones is selected for display.

* * * * *